United States Patent [19]

Linnert

[11] 4,200,426

[45] Apr. 29, 1980

[54] HERMETIC COMPRESSOR ASSEMBLY INCLUDING TORQUE REACTION LEAF SPRING MEANS

[75] Inventor: Peter J. Linnert, La Crosse, Wis.

[73] Assignee: The Trane Company, LaCrosse, Wis.

[21] Appl. No.: 955,034

[22] Filed: Oct. 26, 1978

[51] Int. Cl.[2] ..... F04B 35/04

[52] U.S. Cl. ..... 417/312; 417/363; 417/902; 62/295; 248/638; 310/51; 417/419

[58] Field of Search ..... 417/419, 363, 902, 312, 417/313; 248/607, 638; 310/51; 62/295

[56] References Cited

U.S. PATENT DOCUMENTS

| | | | |
|---|---|---|---|
| 2,977,043 | 3/1961 | Scheldorf | 417/363 |
| 3,171,588 | 3/1965 | Ayling | 417/363 |
| 3,262,661 | 7/1966 | Johnson et al. | 248/638 X |
| 3,385,542 | 5/1968 | Enemart et al. | 417/363 X |
| 3,572,975 | 3/1971 | Valbjorg et al. | 417/363 |
| 3,887,304 | 6/1975 | Otaki et al. | 417/363 |

*Primary Examiner*—Richard E. Gluck

*Attorney, Agent, or Firm*—Carl M. Lewis; Peter D. Ferguson

[57] ABSTRACT

A hermetic compressor assembly is disclosed wherein a motor-compressor unit is supported in a hermetically sealed chamber so as to permit at least limited rotation thereof about an axis which may coincide with the axis of the drive shaft of the compressor. In order to limit such rotation, at least a first leaf spring member is provided affixed to one of the interior wall of the chamber and the motor-compressor unit, which member cooperates with abutment means affixed to the other of said interior wall and motor compressor unit whereby, upon rotation of the motor-compressor unit about said axis, engagement between the abutment means and the leaf spring member results in deflection thereof so as to limit such rotation.

15 Claims, 4 Drawing Figures

FIG. 1
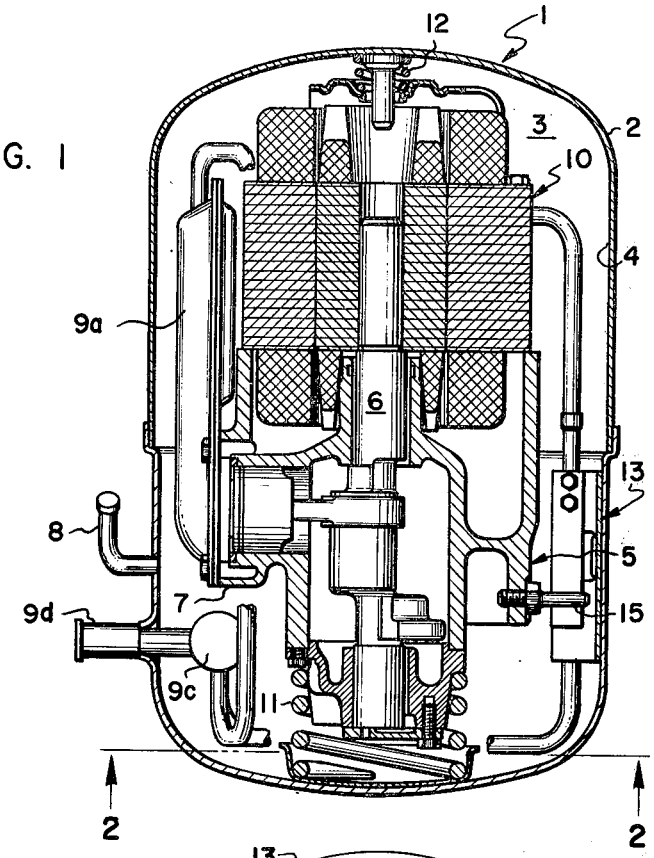
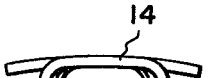
FIG. 4
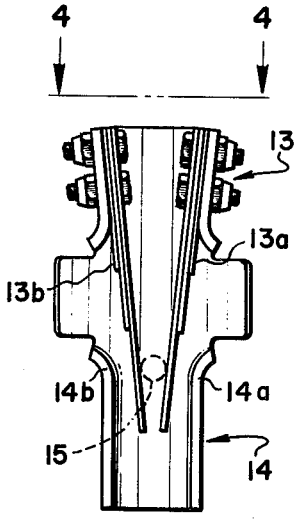
FIG. 3
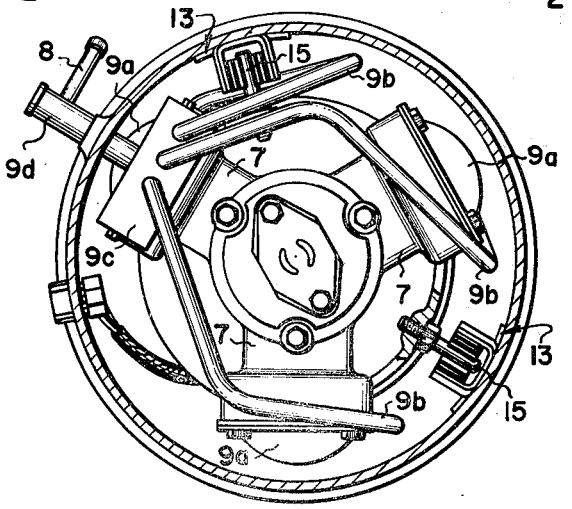
FIG. 2

HERMETIC COMPRESSOR ASSEMBLY INCLUDING TORQUE REACTION LEAF SPRING MEANS

DESCRIPTION

1. Technical Field

The present invention relates to an improvement in the field of hermetic compressors and is directed specifically to the manner in which a motor-compressor unit is supported within a hermetic shell such that the torque reaction produced during start and stop of the compressor is accommodated.

2. Background Art

In a first type of prior art compressor suspension systems, the motor-compressor unit is supported upon several radially arranged coil springs such that the torque reaction attendant upon start-stop is absorbed by lateral deflection of these coil springs. A disadvantage of this type suspension arises due to the fact that these coil springs must be sufficiently stiff to withstand the lateral forces presented by the torque reaction, while being sufficiently soft so as to provide the desired vibration isolation during running. In some instances, this scheme may require two sets of such coil springs, a first comprising relatively stiff springs and a second comprising relatively soft springs for vibration isolation.

A second type of compressor suspension which has been used previously is shown in U.S. Pat. No. 3,171,588 and comprises one or more centrally disposed coil springs for supporting the motor-compressor unit at its base so as to permit rotation thereof. In order to limit such rotation during start-stop, a plurality of coil spring members are provided having their axes generally transverse to the first-mentioned coil spring support members, which co-act between the motor-compressor unit and shell so as to limit relative rotation therebetween. The use of leaf spring members in lieu of coil spring members provides advantages over this scheme in terms of compactness, cost, and ease of assembly.

DISCLOSURE OF THE INVENTION

In accordance with the present invention, a hermetic compressor assembly is provided comprising a shell which defines an enclosed, hermetically sealed chamber bounded by an interior wall and having disposed therein a compressor having a drive shaft extending along a first axis. Suction and discharge conduit means provide communication between the compressor and the exterior of said chamber. Also disposed within said chamber is a motor connected to said drive shaft and united to the compressor so as to define an integral motor-compressor unit.

Means are provided for supporting the motor-compressor unit within the hermetically sealed chamber so as to permit at least limited rotation about a second axis generally parallel to said first axis; which second axis is, in the preferred embodiment, coextensive with said first axis.

In order to limit the rotation of the motor-compressor unit, leaf spring means are provided which comprise at least a first leaf spring member affixed at a first end portion thereof to one of the interior wall of the chamber and the motor-compressor unit, which leaf spring member extends therefrom along a first longitudinal axis generally parallel to and spaced radially from said second axis, terminating in a second end portion free for deflection in a direction generally transverse to the plane defined by said second axis and the first longitudinal axis. Abutment means are affixed to the other of said interior wall and said motor-compressor unit and disposed adjacent the second end portion of the leaf spring member whereby, upon rotation of the motor-compressor unit about said second axis, engagement between the abutment means and the second end portion results in deflection of the leaf spring member so as to limit said rotation.

In a preferred embodiment, a second leaf spring member is provided similar to said first leaf spring member but spaced therefrom in their respective directions of deflection, whereby the abutment means may be disposed therebetween such that, upon rotation of the motor-compressor unit in either direction, deflection of one of said leaf spring members will limit said rotation.

Preferably, the first and second leaf spring members are disposed in slightly inclined relationship with respect to each other so as to define a generally V-shaped passage therebetween for reception of the abutment means.

The present invention is especially advantageous when utilized in conjunction with a compressor of the reciprocating type having a plurality of cylinders extending radially from said first axis, and wherein the interior wall of the shell is of generally circular cross-section such that the cylinders are closely spaced thereto. The compressor is further provided with individual cylinder head mufflers and discharge lines leading from each cylinder and disposed at least partially in the circumferential spaces between adjacent cylinders. The disclosed arrangement utilizing leaf springs in lieu of coil springs provides a distinct space saving advantages in this instance.

Accordingly, it is an object of the present invention to provide a hermetic compressor assembly wherein leaf spring means are utilized in order to limit the rotation of the motor-compressor assembly during start-stop.

Another object of the present invention is to utilize leaf spring means as aforesaid so as to provide a compact arrangement of parts, especially in conjunction with a compressor of the reciprocating type having cylinders which extend radially within the hermetic shell.

Yet another object of the invention is the provision of a leaf spring arrangement as aforesaid which facilitates the assembly of the motor-compressor unit into the hermetic shell.

These and further objects of the invention will become apparent from the following description of a preferred embodiment and by reference to the accompanying drawings.

BRIEF DESCRIPTION OF THE DRAWINGS

FIG. 1 is a view taken in cross-section of a hermetic compressor assembly constructed in accordance with the present invention.

FIG. 2 is a cross-section view taken along the line 2—2 of FIG. 1.

FIG. 3 is a front elevation view of the leaf spring assembly constructed in accordance with the present invention.

FIG. 4 is a view taken along the line 4—4 of FIG. 3.

BEST MODE FOR CARRYING OUT THE INVENTION

As seen in FIG. 1 of the drawings, a hermetic compressor assembly indicated generally by the reference numeral 1 is provided which includes a shell 2 defining an enclosed hermetically sealed chamber 3 which is bounded by an interior wall 4. Disposed within chamber 3 is a compressor indicated generally by reference numeral 5 having a drive shaft 6 extending along a first axis. As shown, compressor 5 is of the well-known reciprocating type and includes a plurality of cylinders 7 (see FIG. 2) which extend radially with respect to the first axis defined by the compressor drive shaft. Suction conduit means 8 are provided which provide communication between the suction side of compressor 5 and the exterior of chamber 3; and discharge conduit means comprising individual cylinder head mufflers 9*a*, discharge lines 9*b*, manifold 9*c*, and discharge line 9*d* convey compressed gas from the compressor to the exterior of chamber 3. It should be noted that mufflers 9*a* and discharge lines 9*b* are at least partially disposed in the circumferential space between adjacent cylinders 7 and the interior wall 4 of shell 2, which wall has a generally circular cross section as seen in FIG. 2.

Also disposed within chamber 3 is a motor indicated generally at 10 which, as is conventional, comprises a stator, and a rotor which is drivingly connected to drive shaft 6 of compressor 5. As is also conventional, the motor is united to the compressor 5 in order to define an integral motor-compressor unit.

The motor-compressor unit is supported within chamber 3 at its base by a first coil spring 11 having a longitudinal axis which generally coincides with the first axis defined by drive shaft 6. This arrangement permits at least limited rotation of the motor-compressor unit within chamber 3 about a second axis which, in the in the preferred embodiment illustrated, coextends along a common line with the first axis defined by drive shaft 6.

At the upper end of the motor-compressor unit, a second coil spring 12 is provided which is disposed between an upper end portion thereof and the upper wall of chamber 3, the longitudinal axis of spring 12 generally coinciding with the first axis defined by drive shaft 6 and the second axis of rotation defined by coil spring 11.

As will be appreciated by those skilled in the art, upon starting and stopping of compressor 5, a torque reaction is produced which tends to impart rotation to the motor-compressor unit about the second axis as defined by the longitudinal axes of coil springs 11 and 12.

In order to limit such rotation of the motor-compressor unit, leaf spring means indicated generally by reference numeral 13 are provided. As best seen in FIGS. 3 and 4, leaf spring means 13 comprise a first leaf spring member 13*a* and a second leaf spring member 13*b* which are affixed at first end portions thereof to interior wall 4 of shell 2 by way of bracket 14 and extend therefrom along longitudinal axes generally parallel to and spaced radially from the second axis defined by the longitudinal axes of coil springs 11 and 12, terminating in second end portions free for deflection in a direction generally transverse to the plane defined by the aforementioned second axis and the respective longitudinal axes of the leaf spring members. As is further apparent from FIG. 3, the respective second end portions of leaf spring members 13*a* and 13*b* are spaced from each other in their respective directions of deflection.

In the preferred embodiment, each leaf spring member 13*a* and 13*b* comprise a plurality of individual leaf spring elements disposed in overlying relationship, with the elements of each member being of varying length along their longitudinal axes such that the aforementioned second end portions thereof are provided by the longest said element in each respective leaf spring member. Although the preferred embodiment illustrated includes three such leaf spring elements, the exact number will vary in accordance with design factors such as the size of the motor-compressor unit, availability of spring stock in desired thicknesses, and the tolerable operating stress levels.

It will be appreciated that each leaf spring member thus comprises a tapered beam member such that substantially uniform stress levels are maintained therein upon deflection. Obviously, such members could also be constructed from a single, integral member having the requisite tapered form.

Abutment means 15 are provided which are affixed to the motor-compressor unit and disposed adjacent the second end portions of leaf spring members 13*a* and 13b whereby, as should be apparent, upon rotation of the motor-compressor unit about the second axis defined by coil springs 11 and 12, engagement between abutment means and the second end portions results in deflection of the appropriate leaf spring member so as limit said rotation. In the preferred embodiment, abutment means 15 simply comprise an elongated rodlike member extending radially from the motor-compressor unit to a position between the second end portions of leaf spring members 13*a* and 13*b*.

Bracket 14, which may be suitably affixed to interior wall 4 of shell 2 as by spot welding, also includes spring stop portions 14*a* and 14*b*, respectively, in order to limit the deflection of leaf spring members 13*a* and 13*b*.

From a perusal of FIG. 2 of the drawings, it may be appreciated that two sets of leaf spring means and cooperating abutment means are provided at spaced locations about the motor-compressor unit. Although it would be preferable that such means be symmetrically spaced about the periphery of the motor-compressor unit, this would not be possible in the case of a three-cylinder radial compressor having equally spaced cylinders as shown, assuming that only two such leaf spring means and cooperating abutment means are provided.

In the preferred embodiment, first and second leaf spring members 13*a* and 13*b* extend generally in the same direction between their respective first and second end portions and have their respective longitudinal axes slightly inclined with respect to each other, as best seen in FIG. 3, so as to define a generally V-shaped passage therebetween for reception of abutment means 15. This particular arangement facilitates assembly of the hermetic compressor assembly in that the motor-compressor unit may simply be lowered into the bottom portion of shell 2 such that the abutment means slide into the passage defined between leaf spring members 13*a* and 13*b*.

It should be noted from FIG. 2 that the leaf spring means 13 and cooperating abutment means 15 occupy a minimum of space in the circumferential direction, as contrasted with those compressor suspension scheme utilizing coil springs, which is a distinct advantage in the case of a reciprocating compressor having radially disposed cylinders as shown, and further provided with individual cylinder head mufflers 9a and discharge lines 9b which are at least partially disposed within the same circumferential space.

Although in the preferred embodiment, the leaf spring means are affixed to the interior wall 4 of shell 2, with abutment means 15 being affixed to the motor-compressor unit, it is possible that the relative positions of these components could be reversed; e.g., with the leaf spring means mounted to the motor-compressor unit and the abutment means mounted to interior wall 4 of shell 2, without departing from the scope or spirit of the invention. Moreover, it is possible that the leaf spring means may comprise a single leaf spring member with the abutment means comprising a bifurcated member engaging the leaf spring member on both sides thereof so as to provide engagement therebetween upon rotation of the motor-compressor unit in either direction.

As used herein, the term "leaf spring" is intended to denote a spring member constructed of one or more flat, plate-like elements having opposed, generally planar surfaces and which extends along a longitudinal axis for deflection in a direction substantially normal to said planar surfaces and said longitudinal axis.

While the invention has been described with respect to a preferred embodiment, it is to be understood that modifications thereto will become apparent to those skilled in the art within the scope of the invention, as defined in the claims which follow.

I claim:

1. A hermetic compressor assembly comprising a. a shell defining an enclosed, hermetically sealed chamber bounded by an interior wall;

b. a compressor disposed within said chamber having a driveshaft extending along a first axis;

c. suction and discharge conduit means for providing communication between said compressor and the exterior of said chamber;

d. a motor also disposed within said chamber and drivingly connected to said driveshaft, said compressor and motor being united to each other so as to define an integral motor-compressor unit;

e. means for supporting said motorcompressor unit within said chamber so as to permit at least limited rotation about a second axis generally parallel to said first axis; wherein the improvement comprises f. leaf spring means comprising at least a first leaf spring member affixed at a first end portion thereof to one of said interior wall and said motorcompressor unit and extending therefrom along a first longitudinal axis generally parallel to and spaced radially from said second axis, terminating in a second end portion free for deflection in a direction generally transverse to the plane defined by said second axis and said first longitudinal axis; and g. abutment means affixed to the other of said interior wall and said motor-compressor unit and disposed adjacent the second end portion of said leaf spring member whereby, upon rotation of said motor-compressor unit about said second axis, engagement between said abutment means and said second end portion results in deflection of said leaf spring member so as to limit said rotation.

2. The hermetic compressor assembly of claim 1 wherein said first and second axes coextend generally along a common line.

3. The hermetic compressor assembly of claim 2 wherein said means for supporting said motor-compressor unit comprise a first coil spring disposed between a lower end portion thereof and the lower wall of said chamber, the longitudinal axis of said first coil spring generally coinciding with said first and second axes.

4. The hermetic compressor assembly of claim 3 wherein said means for supporting said motor-compressor unit further comprise a second coil spring disposed between an upper end portion thereof and the upper wall of said chamber, the longitudinal axis of said second coil spring generally coinciding with said first and second axes.

5. The heremetic compressor assembly of claim 1 wherein said compressor is of the reciprocating type having a plurality of cylinders extending radially from said first axis, the interior wall of said shell being of generally circular cross-section in a plane taken generally perpendicular to said first axis and closely spaced to the outer extremeties of said cylinders.

6. The hermetic compressor assembly of claim 5 wherein said discharge conduit means include individual cylinder head mufflers and discharge lines leading from each cylinder and disposed at least partially in the circumferential spaces between adjacent cylinders.

7. The hermetic compressor assembly of claim 1 wherein said leaf spring means are affixed to the interior wall of said shell and said abutment means are affixed to said motor-compressor unit.

8. The hermetic compressor assembly of claims 1, 2, 3, 4, 5, 6, or 7 wherein said leaf spring means further comprise a second leaf spring member affixed at a first end portion thereof to said one of said interior wall and said motor-compressor unit and extending therefrom along a second longitudinal axis generally parallel to and spaced radially from said second axis, terminating in a second end portion free for deflection in a direction generally transverse to the plane defined by said second axis and said second longitudinal axis, the second end portions of said first and second leaf spring members being spaced from each other in their respective directions of deflection; said abutment means being disposed between said second end portions whereby, upon rotation of said motor-compressor unit in either direction, engagement between said abutment means and one of said second end portions results in deflection of said one of said leaf spring members so as to limit said rotation.

9. The hermetic compressor assembly of claim 8 wherein said first and second leaf spring members each comprise a plurality of leaf spring elements disposed in overlying relationship.

10. The hermetic compressor assembly of claim 9 wherein the leaf spring elements of each of said first and second leaf spring members are of varying length along their longitudinal axes, said second end portions being provided by the longest said element in each of said members.

11. The hermetic compressor assembly of claim 10 wherein each of said first and second leaf spring members includes three leaf spring elements.

12. The hermetic compressor assembly of claim 8 wherein said first and second leaf spring members extend in generally the same direction between their respective first and second end portions and wherein the respective longitudinal axes thereof are slightly inclined with respect to each other so as to define a generally V-shaped passage therebetween for reception of said abutment means.

13. The hermetic compressor assembly of claim 8 wherein said abutment means comprise an elongated rodlike member extending radially from the other of said interior wall and said motor-compressor unit to a position between said second end portions.

14. The hermetic compressor assembly of claim 1 wherein a plurality of leaf spring means and cooperating abutment means are provided at spaced locations about said motor-compressor unit.

15. The hermetic compressor assembly of claim 1 further comprising stop means for limiting the deflection of said first leaf spring member.

* * * * *